United States Patent [19]

Grunwald et al.

[11] Patent Number: 5,011,384

[45] Date of Patent: Apr. 30, 1991

[54] SLIDER BLOCK RADIAL COMPLIANCE MECHANISM FOR A SCROLL COMPRESSOR

[75] Inventors: Stefan H. Grunwald, Liverpool; Howard H. Fraser, Jr., Lafayette, both of N.Y.

[73] Assignee: Carrier Corporation, Syracuse, N.Y.

[21] Appl. No.: 444,238

[22] Filed: Dec. 1, 1989

[51] Int. Cl.[5] ..... F04C 18/04; F04C 29/02

[52] U.S. Cl. ..... 418/55.5; 418/55.6; 418/57

[58] Field of Search ..... 418/14, 55 D, 55 E, 418/57, 94, 55.5, 55.6

[56] References Cited

U.S. PATENT DOCUMENTS 4,457,675 7/1984 Inagaki et al. ..... 418/55 D 4,764,096 8/1988 Sawai et al. ..... 418/55 D

FOREIGN PATENT DOCUMENTS 55-60684 5/1980 Japan ..... 418/55 D 59-120794 7/1984 Japan ..... 418/55 D 62-111185 5/1987 Japan ..... 418/55 E

*Primary Examiner*—John J. Vrablik

*Attorney, Agent, or Firm*—David J. Zobkiw

[57] ABSTRACT

A slider block radial compliance mechanism includes a slider block and a bearing seat which form a subassembly and are located in a circular counterbore in the crankshaft. The slider block has a bore which receives the boss of an orbiting scroll. The orbiting scroll and its boss are held to an orbiting motion while the slider block, bearing seat and crankshaft rotates as a unit with respect to the boss.

12 Claims, 2 Drawing Sheets

SLIDER BLOCK RADIAL COMPLIANCE MECHANISM FOR A SCROLL COMPRESSOR

BACKGROUND OF THE INVENTION

In a scroll compressor the trapped volumes are in the shape of lunettes and are defined between the wraps or elements of the fixed and orbiting scrolls and their end plates. The ends of the lunettes define points of tangency or contact between the wraps of the fixed and orbiting scrolls. These points of tangency or contact are transient in that they are continuously moving towards the center of the wraps as the trapped volumes continue to reduce in size until they are exposed to the outlet port. These points of tangency or contact represent points of wear and leakage so it is desirable to permit outward radial movement of the orbiting scroll to maintain sealing contact of its wrap with that of the fixed scroll. Further, because the trapped volume may contain a liquid slug of refrigerant and/or oil it is desirable to permit inward radial movement of the orbiting scroll to permit leakage from the trapped volume(s) to relieve any excessive buildup of pressure. One approach has been to use an eccentric bushing mechanism to provide the connection between the crankshaft and the orbiting scroll. Another approach has been to use a swing link connection between the orbiting scroll and crankshaft. A slider block radial compliance device is briefly mentioned in U.S. Pat. No. 3,924,977. In this patent, the centrifugal force of the orbiting scroll is used to activate the mechanism. The line of movement of the orbiting scroll is along the centrifugal force, i.e. along the line extending from the center of gravity of the counterweight through the center of the crankshaft to the center of the orbiting scroll.

SUMMARY OF THE INVENTION

The present invention is directed to an improved slider block radial compliance mechanism. The radial compliance mechanism consists of a round counterbore in the end of the eccentric shaft and a subassembly located in the counterbore. The subassembly is made up of a bearing seat and a slider block. The slider block has an eccentric bore for receiving the boss of the orbiting scroll and has a segment of a cylindrical surface circumferentially extending for at least 180°, in the preferred embodiment, and having at least one flat. The bearing seat includes a generally circular portion received in and covering the bottom of the counterbore and an axially extending portion having a first portion complementary to the flat of the slider block and a second portion complementary to said counterbore.

It is an object of this invention to provide an effective radial compliance mechanism.

It is another object of this invention to provide a more readily manufactured and readily assembled radial compliance mechanism.

It is a further object of this invention to reduce the friction between the parts of a radial compliance mechanism. These objects, and others as will become apparent hereinafter, are accomplished by the present invention.

Basically, the bearing seat and slider block rotate with the eccentric shaft and with respect to the boss of the orbiting scroll which is carried through an orbiting path relative to the axis of rotation of the eccentric shaft. Some movement of the slider block is possible within the counterbore with the movement being in the nature of a sliding motion of the slider block while engaging the generally cylindrical portion and the complementary flat portion of the bearing seat. The amount of movement permitted will generally be on the order of 0.05 to 0.1 inches.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
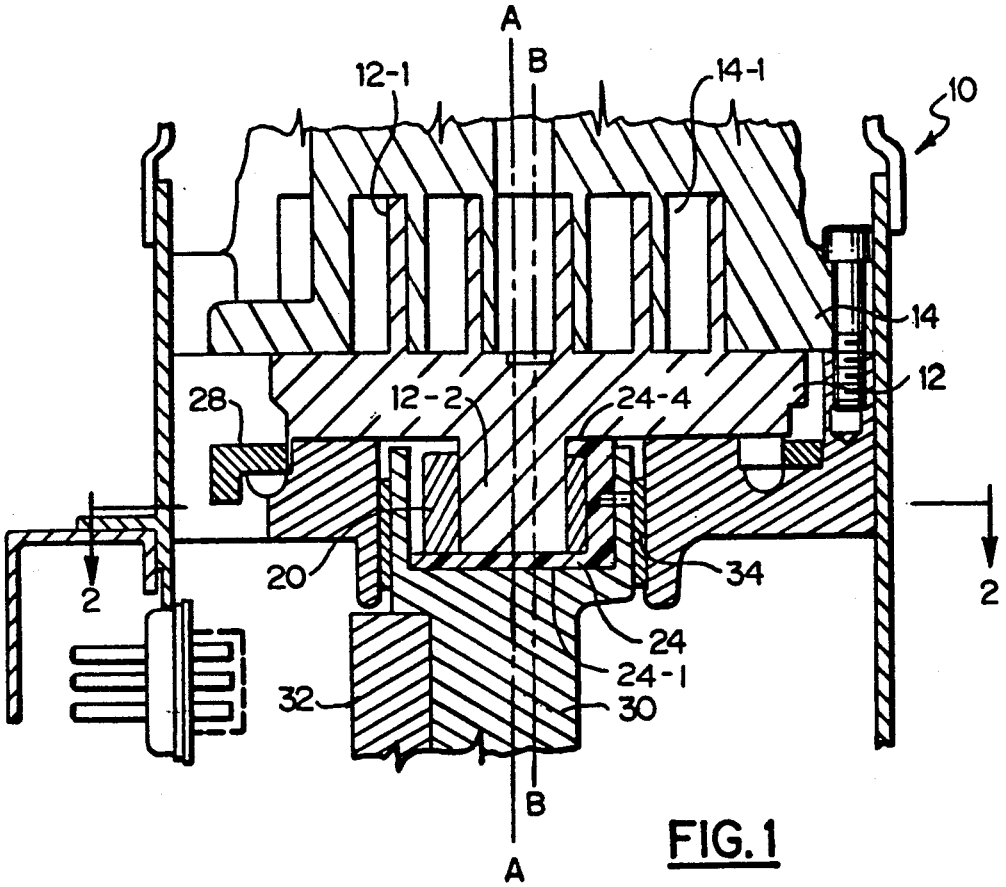
FIG. 1 is a vertical sectional view of a portion of a scroll compressor employing the slider block mechanism of the present invention and corresponds to a section taken through 1—1 of FIG. 2.
Figure 2:
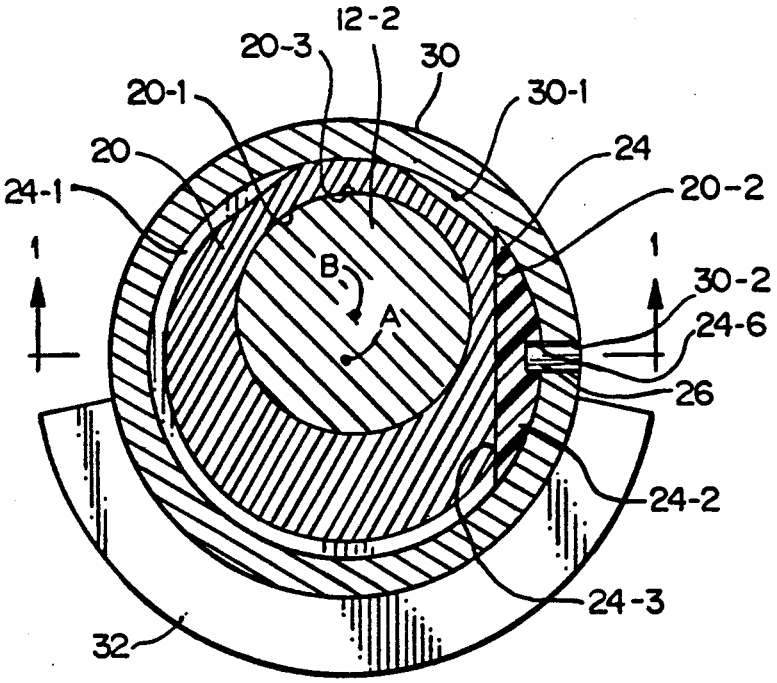
FIG. 2 is a sectional view of the slider block mechanism taken along line 2—2 of FIG. 1 but showing the orbiting scroll repositioned.
Figure 3:
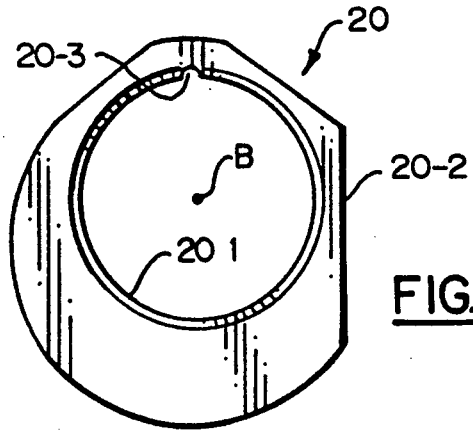
FIG. 3 is a top view of the slider block.
Figure 4:
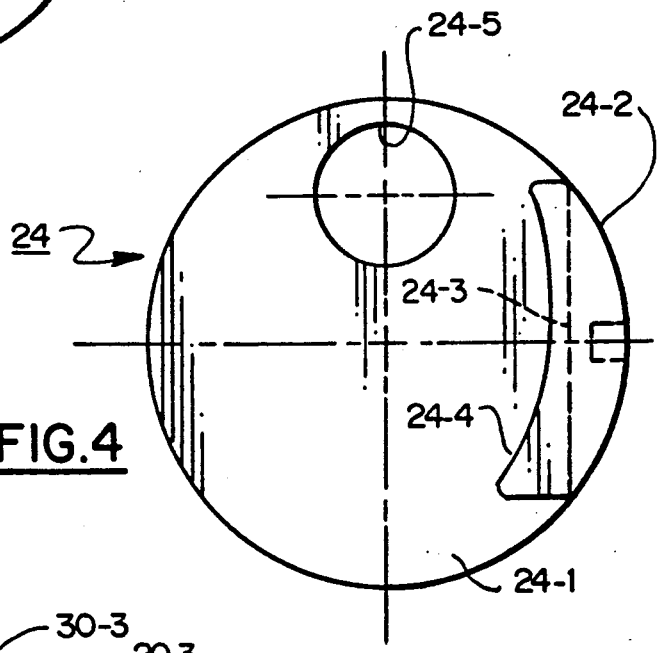
FIG. 4 is a top view of the bearing seat.
Figure 5:
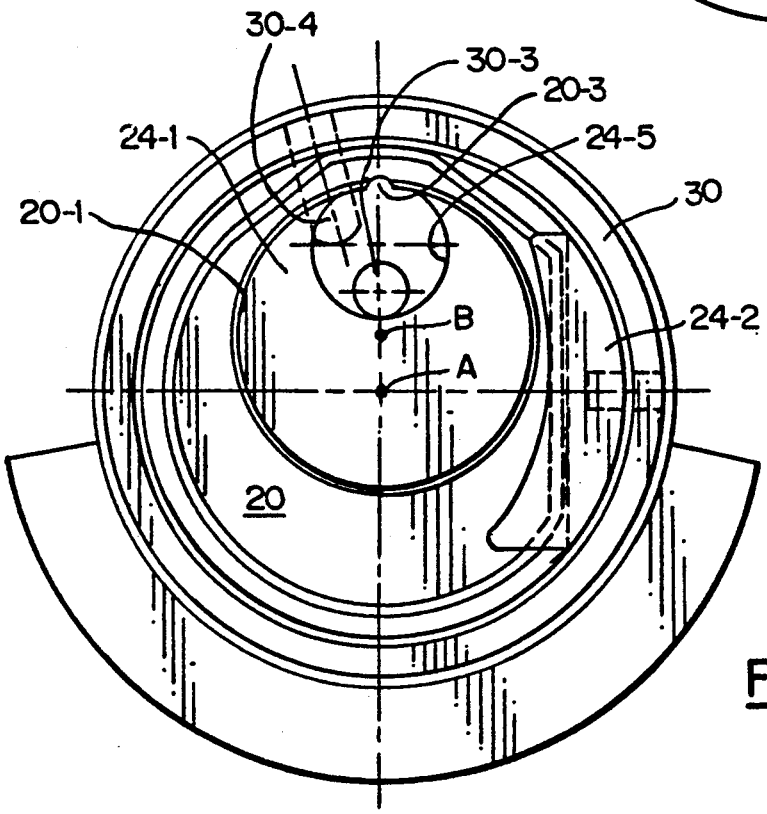
FIG. 5 is an unsectioned top view corresponding to FIG. 2 and with the orbiting scroll structure removed.

In FIG. 1, the numeral 10 generally indicates a scroll compressor which is only partially illustrated. Scroll compressor 10 includes an orbiting scroll 12 with a wrap 12-1 and a fixed scroll 14 with a wrap 14-1. Orbiting scroll 12 has a boss 12-2 which is received in bore 20-1 of slider block 20. The line B—B represents the center of orbiting scroll as well as the axis of bore 20-1. Referring specifically to FIG. 3, the slider block 20 includes a flat 20-2 and a groove 20-3 and the axis B—B of bore 20-1 appears as point B. Referring now to FIG. 4, bearing seat 24 is made of molded polyphenylene sulfide containing 30% glass fiber and 15% polytetrafluorethylene which has a small coefficient of friction and has a flat circular portion 24-1, an axially extending portion 24-2 having a flat 24-3, a radially extending portion 24-4 and an eccentric bore 24-5 in circular portion 24-1. As is best shown in FIGS. 2 and 5, slider block 20 and bearing seat 24 are received in counterbore 30-1 of crankshaft 30 as a subassembly with slider block 20 located between circular portion 24-1 and radially extending portion 24-4 such that flat 20-2 can engage flat 24-3. Radially extending portion 24-4 prevents relative axial movement of the slider block 20 in the subassembly. After the slider block 20 and bearing seat 24 are placed in counterbore 30-1, bearing seat 24 is fixed relative to crankshaft 30 by screw or pin 26 which extends through bore 30-2 into bore 24-6. As a result, bearing seat 24 rotates with crankshaft 30 as a unit about A—A the axis of rotation of crankshaft 30. A reciprocating motion of slider block 20 in counterbore 30-1 is the only significant relative motion of slider block 20 with respect to bearing seat 24 and crankshaft 30 during operation and this movement is generally on the order of 0.05 to 0.1 inches, at most. Specifically, slider block 20 is supported on the low friction circular portion 24-1 so that flat 20-2 engages flat 24-3 such that flats 20-2 and 24-3 are parallel to a plane defined by axes A—A and B—B which appear as points A and B, respectively, in FIG. 5.

During operation, as crankshaft 30, counterweight 32, bearing seat 24 and slider block 20 rotate together about A—A the axis of crankshaft 30, centrifugal force acts on slider block 20 causing it to move radially outward in counterbore 30-1 relative to A—A and along the plane defined by axes A—A and B—B. The engagement of flats 20-2 and 24-3 which are parallel to the plane defined by A—A and B—B coupled with the low friction surface of flat 24-3 facilitates movement of slider block 20 since little or no oil will reach the surface between flats 20-2 and 24-3. As slider block 20 moves, it carries boss 12-2 and, therefore, orbiting scroll 12 with it such that axis A—A of orbiting scroll 12 orbits about axis B—B. Subject to the movement of slider block 20 due to centrifugal force and the gas forces acting on wrap 12-1 and any movement due to overriding a liquid slug or the like, slider block 20 generally moves as a unit with bearing seat 24 and crankshaft 30.

As crankshaft 30 rotates, oil from the sump (not illustrated) is forced into eccentric generally axial bore 30-3 which acts as a centrifugal pump. The pumped lubricant passes into counterbore 30-1 of the crankshaft 30, through bore 24-5 of the bearing seat 24 and through axial groove 20-3 of the slider block 20 where it lubricates boss 12-2 of the orbiting scroll 12. While crankshaft 30, bearing seat 24 and slider block 20 are rotating, boss 12-2 and orbiting scroll are held to an orbiting motion by Oldham ring 28. As a result, groove 20-3 traverses the cylindrical surface of boss 12-2 providing lubrication thereto. Lubricant supplied to counterbore 30-1 also is directed via bore 30-4 to provide lubrication to the bearings 34 and orbiting scroll 12.

From the foregoing, it should be clear that the present invention facilitates manufacture by permitting the use of circular counterbore 30-1 and facilitates assembly by permitting the slider block 20 and bearing seat 24 to be inserted into counterbore 30-1 as a unit. Further, bearing seat 24 can be molded or extruded to shape.

Although a preferred embodiment of the present invention has been illustrated and described, other changes will occur to those skilled in the art. It is therefore intended that the scope of the present invention is to be limited only the scope of the appended claims.

What is claimed is:

1. In a scroll compressor means having an orbiting scroll means including an axis, a fixed scroll means, crankshaft means having a first and a second end and adapted to rotate about an axis of said crankshaft means, a slider block radial compliance mechanism comprising:

a circular recess means formed in said first end of said crankshaft means;

bearing seat means fixedly located in said recess means and having a flat circular portion and an axially extending portion;

slider block means located in said recess means;

said recess means and said bearing seat means coacting with said slider block means to limit movement of said slider block means to substantially only relative reciprocating movement of said slider block means with respect to said bearing seat means; and said slider block means and said orbiting scroll means coacting to permit relative rotary motion of said axis of said orbiting scroll means about said axis of said crankshaft means and said orbiting scroll means is moved with said slider block means when said slider block means moves in relative reciprocating movement in said recess means.

2. In the scroll compressor means of claim 1 wherein said axially extending portion and said slider block means each has a flat with said flats coacting to permit said relative reciprocating movement of said slider block means.

3. In the scroll compressor means of claim 1 wherein said slider block means forms a portion of a cylinder with said cylinder having a slightly smaller diameter than said circular recess means so as to permit said relative reciprocating movement of said slider block means.

4. In the scroll compressor means of claim 1 wherein said axially extending portion extends from said flat circular portion to a radially extending portion which overlies said slider block means to limit axial movement of said slider block means and said axially extending portion and said slider block means each has a flat with said flats coacting to permit said relative reciprocating movement of said slider block means.

5. In the scroll compressor means of claim 4 wherein said bearing seat means is made of molded polyphenylene sulfide.

6. In the scroll compressor means of claim 4 wherein said flat circular portion has a bore therein defining a portion of a lubrication path.

7. In the scroll compressor means of claim 1 wherein said orbiting scroll means has an axially extending boss and said slider block means has a bore for receiving said boss with said bore having a groove defining a portion of a lubrication path.

8. A slider block radial compliance mechanism for a scroll compressor having an orbiting scroll with a wrap on one side and driving means on an opposite side and a fixed scroll comprising:

a crankshaft means having a first and a second end and adapted to rotate about an axis of said crankshaft means;

circular recess means formed in said first end such that said axis of said crankshaft means passes through said recess means;

bearing seat means fixedly located in said recess means and having a flat circular portion and an axially extending portion;

slider block means located in said recess means;

said recess means and said bearing seat means coacting with said slider block means to limit movement of said slider block means to substantially only relative reciprocating movement of said slider block means with respect to said bearing seat means; and said slider block means coacting with said driving means to permit relative rotary motion between said driving means and said slider block means and said orbiting scroll means is moved with said slider block means when said slider block means moves in said relative reciprocating movement in said recess means.

9. The slider block radial compliance mechanism of claim 8 wherein said slider block means and said bearing seat means constitute a subassembly and said axially extending portion and said slider block each has a flat with said flats coacting to permit said relative reciprocating movement of said slider block means.

10. The slider block radial compliance mechanism of claim 9 wherein said slider block means forms a portion of a cylinder with said cylinder having a slightly smaller diameter then said circular recess means so as to permit said relative reciprocating movement of said slider block means.

11. The slider block radial compliance mechanism of claim 10 wherein said bearing seat means further includes a radially extending portion extending from said axially extending portion so as to overlie said slider block means to thereby limit axial movement of said slider block means.

12. The slider block radial compliance mechanism of claim 11 wherein said slider block means has a bore therein for receiving said driving means and said bore has a groove which forms a portion of a lubrication path.

* * * * *